US011346055B2

(12) United States Patent
Zhang et al.

(10) Patent No.: US 11,346,055 B2
(45) Date of Patent: May 31, 2022

(54) METHOD AND DEVICE FOR PROTECTING PAPER SHEET

(71) Applicant: HANGZHOU ZHONGCAI TECHNOLOGY CO., LTD., Zhejiang (CN)

(72) Inventors: Xiwen Zhang, Zhejiang (CN); Wenzheng Shi, Zhejiang (CN); Shaoyan Xu, Zhejiang (CN)

(73) Assignee: HANGZHOU ZHONGCAI TECHNOLOGY CO., LTD., Hangzhou (CN)

( * ) Notice: Subject to any disclaimer, the term of this patent is extended or adjusted under 35 U.S.C. 154(b) by 45 days.

(21) Appl. No.: 16/558,305

(22) Filed: Sep. 2, 2019

(65) Prior Publication Data

US 2019/0390410 A1 Dec. 26, 2019

Related U.S. Application Data

(63) Continuation of application No. PCT/CN2018/084335, filed on Apr. 25, 2018.

(30) Foreign Application Priority Data

Sep. 15, 2017 (CN) ..... 201710835116.0

(51) Int. Cl.
*D21H 25/02* (2006.01)
*D21H 25/18* (2006.01)
*D21H 25/04* (2006.01)

(52) U.S. Cl.
CPC ..... *D21H 25/18* (2013.01); *D21H 25/02* (2013.01); *D21H 25/04* (2013.01)

(58) Field of Classification Search
CPC ..... D21H 25/18; D21H 25/02; D21H 25/04
USPC ..... 162/160
See application file for complete search history.

(56) References Cited

U.S. PATENT DOCUMENTS

2004/0056235 A1* 3/2004 Herren ..... B41M 7/0063 252/380
2016/0326692 A1* 11/2016 Gladish ..... D06P 5/2011

FOREIGN PATENT DOCUMENTS

| | | |
|---|---|---|
| CN | 101579661 | 11/2009 |
| CN | 102644218 | 8/2012 |
| CN | 202543729 | 11/2012 |
| CN | 104988801 | 10/2015 |
| CN | 105019305 | 11/2015 |

(Continued)

*Primary Examiner* — Jacob T Minskey
(74) *Attorney, Agent, or Firm* — Jiwen Chen; Jacobson Holman PLLC

(57) ABSTRACT

The present invention relates to a device for protecting paper sheet, including the following. A mist treating system, includes a working cover and a suction port provided on the working cover. A metal base plate is capable of being drawn out from an outlet of the working cover. An inlet and an outlet are provided on the sidewall of the working cover. An insulating layer provided at the top surface of the metal base plate. A sliding rail is provided above the metal base plate. A sprayer is used for applying an atomized deacidification agent to a paper sheet. A discharging electrode is used for discharging to the paper sheet on the insulating layer. The working cover is covered outside of the metal base plate, the insulating layer, the sliding rail, the sprayer, and the discharging electrode. A plasma power supply is used for generating linear plasma.

1 Claim, 4 Drawing Sheets

(56) References Cited

FOREIGN PATENT DOCUMENTS

| | | |
|---|---|---|
| CN | 204738179 | 11/2015 |
| CN | 204817007 | 12/2015 |
| CN | 107460774 | 12/2017 |
| CN | 206721569 | 12/2017 |
| CN | 206941308 | 1/2018 |

* cited by examiner

METHOD AND DEVICE FOR PROTECTING PAPER SHEET

CROSS-REFERENCE TO RELATED APPLICATION

This application is a continuation of international PCT application serial no. PCT/CN2018/084335, filed on Apr. 25, 2018, which claims the priority benefit of China application no. 201710835116.0, filed on Sep. 15, 2017. The entirety of each of the above—mentioned patent applications is hereby incorporated by reference herein and made a part of this specification.

TECHNICAL FIELD

The present invention relates to the technical field of protecting paper sheet, in particular to a method and device for protecting paper sheet.

DESCRIPTION OF RELATED ART

Tens of thousands of archives, books, paintings, newspapers and other paper sheet materials are preserved in various libraries, archives, museums and other units. These paper sheet materials are the precious cultural heritage and have important historical and cultural values that can not be reproduced. A plurality of paper sheet documents have appeared mildew, crushing, pollution, moth and other issues influenced by various factors with the passage of time, and the protection of these cultural materials is facing severe challenges. Despite a plurality of research on acid removal and sterilization of paper sheet in modern times, people are still searching for an ideal paper sheet protection technology. Among them, the traditional solution deacidification method needs to impregnate the sample to be treated in deacidification agent, which can easily lead to paper sheet deformation and discoloration, and the treatment efficiency is low. Although the traditional gas phase deacidification method has high deacidification efficiency and comprehensive effect of insecticide and bactericide, its requirement of high vacuum makes it has high requirements on the devices with big investment. Also, the deacidification agent is toxic. At the same time, the current technology of paper sheet protection is carried out in divisions, which the efficiency is low and the operation is complex.

Atmospheric pressure non-equilibrium plasma contains particles with high energy, which can quickly deacidify paper sheet at room temperature and pressure. For example, CN202543729U patent literature relates to an arc-discharging paper deacidification device, wherein the device includes an air storage tank, a glass rotameter, a sealed liquid storage tank, an insulating ceramic reactor, an arc-discharging spray gun, an insulating ceramic plate, a fixed frame, a first control motor, a second control motor and a computer. Under the condition of room temperature and pressure, the arc-discharging paper deacidification device processes a paper sheet by using a gaseous deacidification agent and arc-discharging jet flow to change the pH value of the paper sheet to a neutral value. The device is simple and easy to operate, and has the advantages of high processing speed and remarkable effect, and no pollution to the environment during the process; and the color and appearance of the processed paper sheet are not changed, and no ink diffusion.

But there are some problems such as low efficiency and uneven deacidification in the said device.

SUMMARY OF THE INVENTION

The present invention relates to a method and device for protecting paper sheet, which have good deacidification effect, high deacidification efficiency and fast bactericidal.

A device for protecting paper sheet includes:

a mist treating system, including a working cover and a suction port provided on the working cover;

a metal base plate in a drawer structure capable of being drawn out from a outlet of the working cover in a slidable manner, an inlet and outlet are provided on a sidewall of the working cover;

an insulating layer provided at a top surface of the metal base plate;

a sliding rail arranged above the metal base plate;

a sprayer movable along the sliding rail and used for applying an atomized deacidification agent to a paper sheet;

a discharging electrode movable along the sliding rail and used for discharging to the paper sheet on the insulating layer;

the working cover being covered outside of the metal base plate, the insulating layer, the sliding rail, the sprayer, and the discharging electrode;

and a plasma power supply supplying power to the metal base plate and the discharging electrode, and generating linear plasma.

The present invention generates plasma between the metal base plate, which bears the paper, and the discharge electrode, which matches with the metal base plate, to sterilize and deacidify pretreatment of the paper sheet to be protected. The paper sheet is deacidified by spraying deacidification agent, and the sliding rail is provided to guide the movement of the discharging electrode and the sprayer, thereby improving the working efficiency and uniformity.

In order to load the paper sheet to be protected conveniently, preferably, a bearing guide rail is provided in the working cover, and the metal base plate is slidably arranged on the bearing rail, and the bearing guide rail and the sliding rail are horizontally arranged and are perpendicular to each other in space. The arrangement can move the metal base plate out of the working cover for loading paper sheet, which is convenient and fast.

The insulating layer is made of polymer material, glass, ceramics and other insulating materials. The insulation layer itself can adopt the prior art. Generally speaking, the insulating layer is thin. When the insulating layer is placed on the top of the metal base plate to provide effective support. The space above the insulating layer is a discharge area.

In order to install and manufacture conveniently, preferably, the sprayer includes:

a first slide block movable along the sliding rail;

a nozzle fixed on the first slide block and arranged horizontally, the nozzle toward a side of the insulating layer is provided with a slit-shaped discharge outlet arranged along the longitudinal direction of the nozzle.

In order to improve the working efficiency of the sprayer, preferably, multiple nozzles are arranged side by side.

In order to keep the sprayer can continuously spray the atomized deacidification agent on the paper sheet surface, a roller type cleaning brush is provided below the static position of the sprayer for cleaning the slit-shaped discharged outlet, which is convenient and quick.

In order to make the spraying of deacidification agent uniformly, preferably, the device for protecting paper sheet includes a deacidification tank and an atomizer, a liquid inlet of the atomizer is connected to the deacidification tank, and an atomization outlet of the atomizer is connected to the sprayer. Atomized deacidification agent has better penetration effect and can effectively reduce the dosage of deacidification agent.

Preferably, the atomizer is ultrasonic atomizer.

In order to install and manufacture conveniently, preferably, the discharging electrode moves along the sliding rail by a second slide block which the discharging electrode is fixed with.

In order to improve the degree of automation, preferably, the device for protecting paper sheet is provided with a driving mechanism which drives the reciprocating motion of the first slide block and the second slide block respectively. The driving mechanism can be driven by a typical motor.

In order to adjust the deacidification agent mist atomized inside the working cover, the mist treating system includes a draught fan and an air flow passage, one side of the air flow passage is connected to the draught fan, and the other side of the air flow passage is connected to the induction port on the working cover, a mist suction net is included in an inside of the air flow passage. Air plasma discharge is sensitive to the humidity of working environment. When the humidity is too high or too low, it will affect the discharge state, and then affect the deacidification effect of the paper sheet, and even causes arc discharge damaging the paper sheet and the device. Through the negative pressure generated by the draught fan and the adjustment and guidance of the airflow passage, the spray-like deacidification agent from the sprayer can be propelled to press the paper sheet tightly and to move evenly, so that the deacidification agent mist can fully contact with the paper sheet and evenly distribute on the surface of the paper sheet to be protected, thus improving the deacidification protection effect of the paper sheet. In addition, the use of mist treating system can make the deacidification agent mist have a clear moving direction, and the deacidification agent mist do not overflow, thus reducing the coagulation of the deacidification agent mist on other working parts, which not only reduces the consumption of the deacidification agent but also protects other parts. At the same time, the excess deacidification agent mist in the working cover can be recovered by using the mist suction net in the airflow passage. When the sprayer is scanned, the outside air can be introduced into the working cover and the gas in the working cover can be discharged simultaneously through the mist treating system. In this process, the atomized deacidification agent can be completely absorbed by the mist suction net. It not only achieves the harmless treatment of the exhausted gas, improves the environmental protection of the device, but also ensures the stability of the subsequent plasma discharge operation by controlling the air humidity in the working cover, and improves the safety and reliability of the device.

In order to improve the efficiency of mist treatment, the mist suction net is a three-dimensional porous filter net woven by composite metal wires, in which the composite metal wires are based on metal wires and the surface is coated with acidic adsorbents. Acidic adsorbents can use various acidic adsorbents in the prior art, such as acidic polyacrylamide, etc. The mist suction net is filled in the air passage. By selecting the material of the mist suction net and the pore diameter of the porous filter net, the atomized deacidification agent in the gas is fully absorbed.

Preferably, the diameter of mist suction net is 0.5 mm-3 mm.

In order to make the paper sheet attaching close to the insulating layer and improving the effect of protective treatment, preferably, the top surface of the insulating layer is provided with a plurality of vacuum suction holes running through the bottom surface of the metal base plate, and a vacuum tube is embedded in the bottom surface of the metal base plate. The side walls of the vacuum tube are connected with the vacuum suction holes, and the vacuum tube is connected with a vacuum pump. The vacuum suction hole can suck the paper sheet to be protected on the insulating layer, so as to stretch and straighten the paper sheet, make the paper sheet fully and evenly contact with the deacidification agent, and fully and evenly contact with the plasma, so as to improve the deacidification effect. In addition, because paper sheet is made of fibers, there are numerous fine and interconnected channels. When atomized deacidification agent contacts with the fibers, the micro-negative pressure formed through the vacuum suction holes can help the penetration of deacidification agent in the paper sheet, thus ensuring the full penetration of deacidification agent into paper, achieving the effect of complete deacidification and not easy to return acid.

In order to install and manufacture conveniently, preferably, an installation groove is provided on the bottom surface of the metal base plate, and the vacuum suction holes are connected to the groove wall of the installation groove, the vacuum tube is embedded in the installation groove.

In order to obtain a higher energy density of linear cryogenic plasma and improve the working efficiency of the device, the plasma power supply is an intermediate frequency high voltage power supply with an operating frequency of 1 kHz to 1 MHz, an operating voltage of 0.5 kV-40 kV, and an operating power of 20 W-2 KW. Preferably, the operating frequency of plasma power supply is 4 kHz to 40 kHz, the operating voltage is 0.8 kV-20 kV, the operating power is 80 W-800 W. Preferably, the operating frequency of plasma power supply is 6 kHz to 20 kHz, the operating voltage is 1.5 kV-10 kV, the operating power is 100 W-500 W.

In order to obtain a higher energy density of linear cryogenic plasma and improve the safety and stability of the device, preferably, the distance between the discharging electrode and the insulating layer is 0.08 mm-5 mm. Preferably, the distance between the discharging electrode and the insulating layer is 0.5 mm-4 mm.

The present invention can generate suitable medium barrier to block the low temperature plasma by adjusting the plasma power supply and combining the appropriate distance between the discharge electrode and the insulating layer.

The low temperature plasma produced by the intermediate frequency plasma power supply and medium barrier has a more concentrated electro-magnetic field, the plasma energy density is higher and the ionization degree is higher than the plasma produced by other methods such as radio frequency. This makes it has more energetic molecules, electrons and ions. And since the temperature of plasma processing area is at room temperature, one can have better control of the heat generated by the plasma discharge, which can fully treat the paper sheet and effectively protect the micro-structure of fibers, ensure the mechanical properties of the treated paper, and make it more friendly to the fragile objects to be protected, such as paper sheet.

The high-energy electrons, ions and free radicals produced in the process of gas discharge generating plasma have high energy. When the linear plasma generated by the device of the present invention is used to scan the paper sheet, the electrons, ions and free radicals generated not only interact with the paper sheet fibers, but also contact with the bacteria and fungi that grow in paper fibers, then destroying the cell membrane of the bacteria and fungi, thereby destroying their cell structure and achieving sterilization effect. At the same time, the selection of plasma power supply, working parameters and distance of discharge electrodes involved in the invention ensures that linear plasma can destroy the cell membrane of the bacteria and fungi without destroying the paper sheet fibers wherein the main component of the paper sheet fibers are cellulose.

In order to remove the ozone generated during discharge, preferably, an ozone removal pipeline is provided above the sliding rail, ozone is removed by heating at 40-300° C.

In order to improve the integration, all the above components are installed in the chassis for easy operation and movement.

The present invention also provides a method for protecting paper sheet applying the device, the method includes:

(1) the paper sheet to be protected is placed on the insulating layer, the discharging electrode starts to discharge and moves along the sliding rail, the paper sheet to be protected is treated by the plasma;

(2) the sprayer moves along the sliding rail and sprays the atomized deacidification agent onto the surface of the paper sheet treated by the plasma.

Preferably, the vacuum pump is turned on and the paper sheet is pretreated by the negative pressure generated by the vacuum suction hole before the discharge electrode starts to discharge. The pretreated paper sheet helps the deacidification agent to penetrate the paper sheet, thereby ensuring the full penetration of the deacidification agent into the paper sheet, to achieve the effect of complete deacidification and not easy acid return.

The present invention firstly performs vacuum suction treatment, then plasma treatment, and finally deacidification agent spray on the paper sheet to this invention realizes the sterilization before the protection of the paper sheet to prevent the acid ingredients produced by the bacteria and fungi growing on the paper fibers. At the same time, plasma pretreatment can open the microchannels of paper fibers, which helps the subsequent deacidification agent penetrating into the inside of paper fibers to achieve the effect of complete deacidification and non-acid return.

The conditions for the method provided in the present invention are mild. Steps (1) and (2) are carried out at room temperature and pressure. Also, the operation of the present invention does not require special gas protection. Steps (1) and (2) are carried out in an air atmosphere.

In Step (1), it does not take long to treat the paper sheet to be protected by plasma. The treatment time can be shortened to several seconds according to the acidification degree of the paper sheet to be protected and the infection degree of bacteria and fungi.

In Step (2), the flow rate of spraying the deacidifying agent can be adjusted according to the degree of acidification of the paper. If the degree of acidification is severe, the spraying flow rate can be adjusted to be relatively large. Preferably, the spraying flow rate of the deacidifying agent is 5 to 500 mL/h, that is, 5 mL to 500 mL of deacidification agent is sprayed onto the surface of the plasma-treated paper every hour.

The deacidification agent is a liquid form with alkaline pH value, and various deacidification agent in the prior art can be used to neutralize acidification groups to form an alkaline buffer zone, such as magnesium bicarbonate aqueous solution, calcium hydroxide aqueous solution, calcium propionate ethanol solution, isobutylamine ethanol aqueous solution, tea water, radish juice, barium hydroxide aqueous solution, methanol magnesium methanol aqueous solution, etc. The pH value of deacidification agent ranges from 8 to 12.

Compared with the prior art, the present invention has the following advantages:

(1) The method for protecting paper sheet of the present invention is more reasonable, the treatment time is short, the acid removal is thorough, and the acid return is not easy.

(2) Paper sheet treatment by using the present invention can effectively prevent the damage of prior art to the paper sheet, thereby further expanding the protection scope of paper sheet.

(3) The present invention can simultaneously realize sterilization and deacidification of paper sheet, and the device operation involved is simple, convenient, safe, environmental friendly and with high efficiency.

(4) The present invention protects the paper sheet without immersing the paper sheet to be protected in the protective solution, and solves the problems of paper sheet deformation and handwriting halo caused by the traditional liquid phase protection method.

DESCRIPTION OF THE EMBODIMENTS

Figure 1:
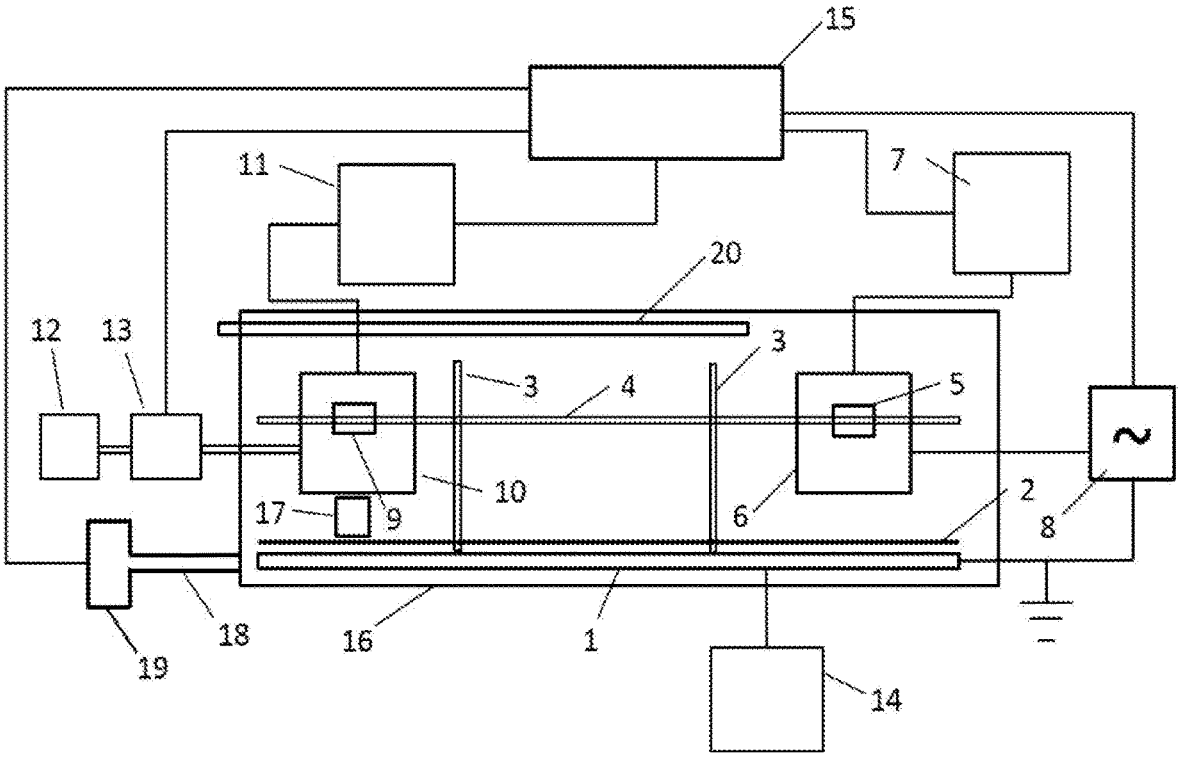
FIG. 1 is a schematic diagram of a device for protecting paper sheet of the present invention.
Figure 2:
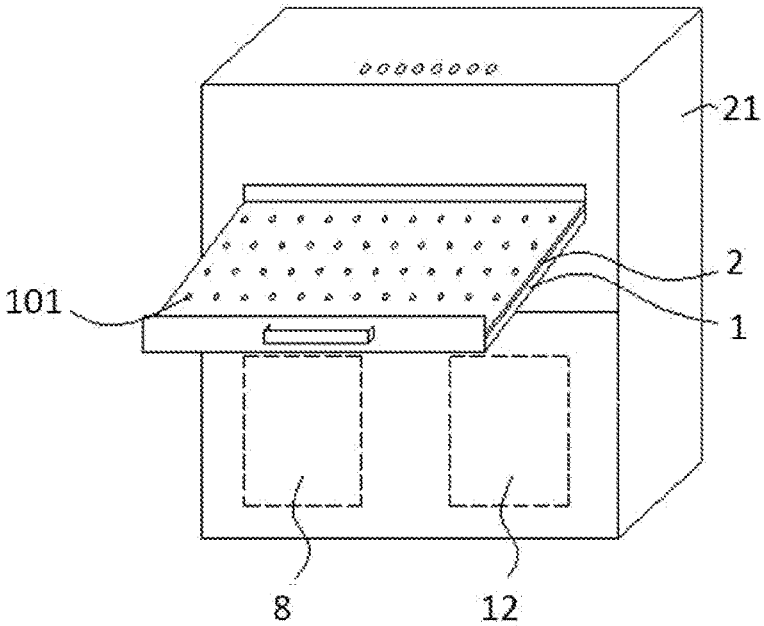
FIG. 2 is a schematic diagram of the structure of a device for protecting paper sheet of the present invention.
Figure 3:
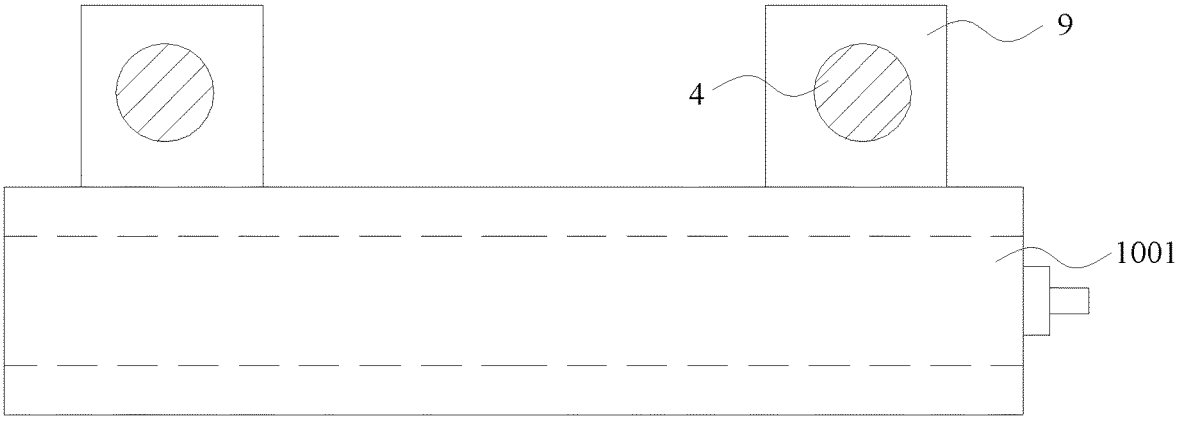
FIG. 3 is a schematic diagram of the structure of a sprayer.
Figure 4:
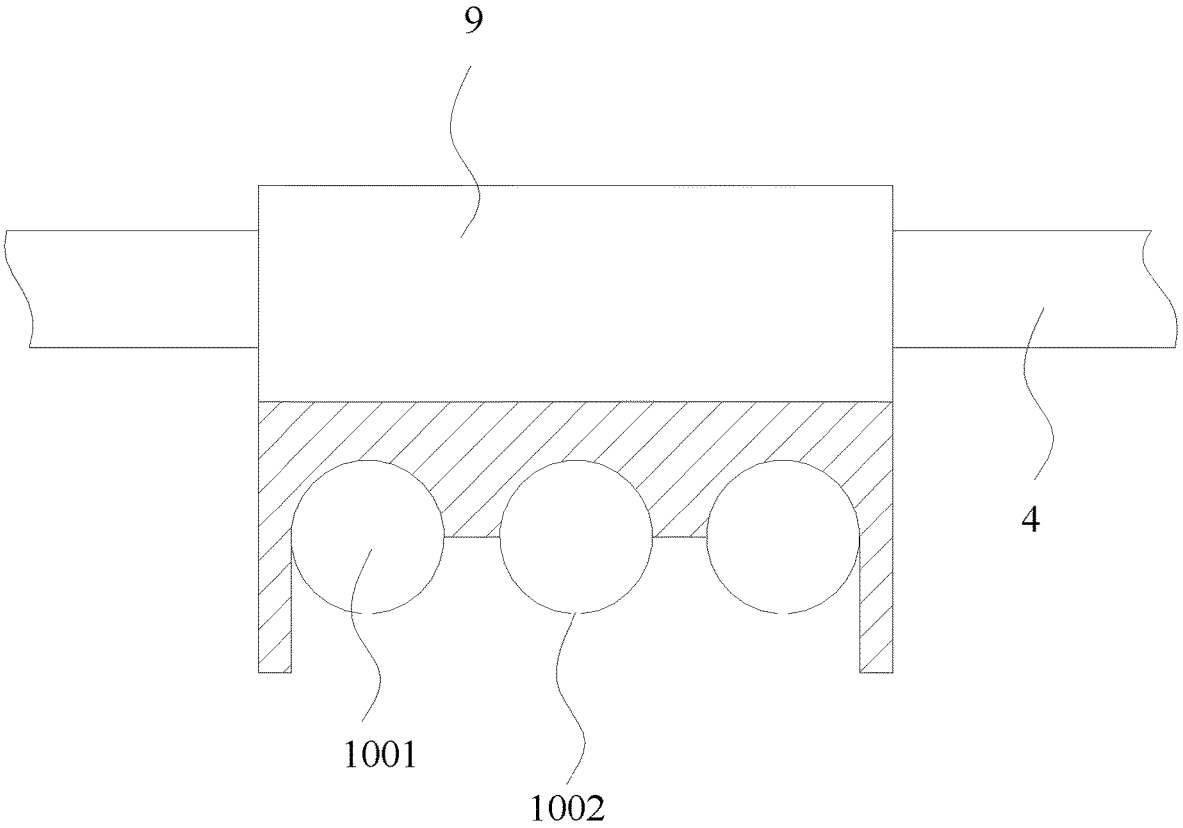
FIG. 4 is a schematic diagram of the structure of a sprayer viewed from another angle.
Figure 5:
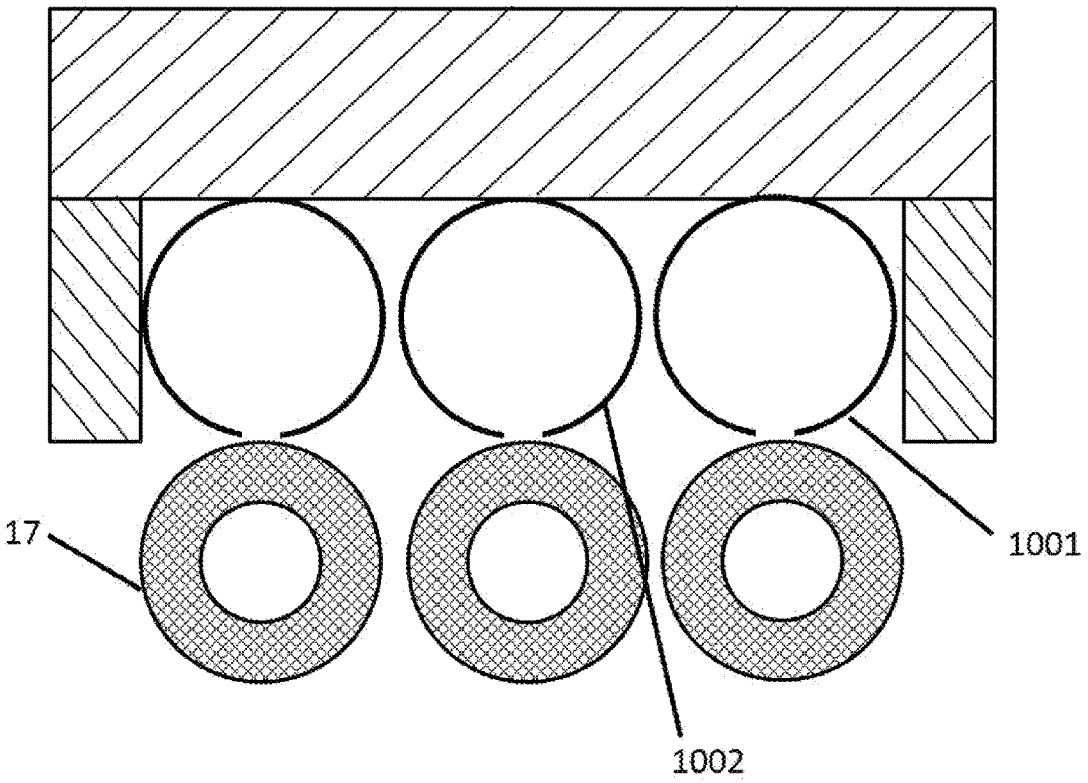
FIG. 5 is a schematic diagram of the structure of a sprayer and a cleaning brush.
Figure 6:
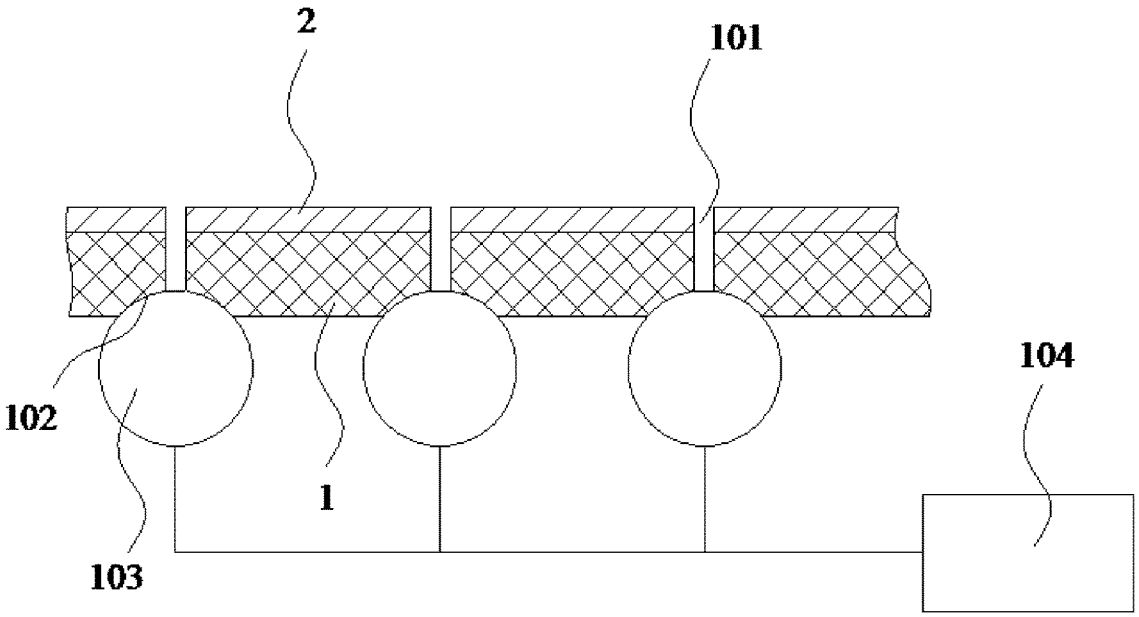
FIG. 6 is a sectional diagram of a metal base plate, an insulating layer and a vacuum tube.
Figure 7:
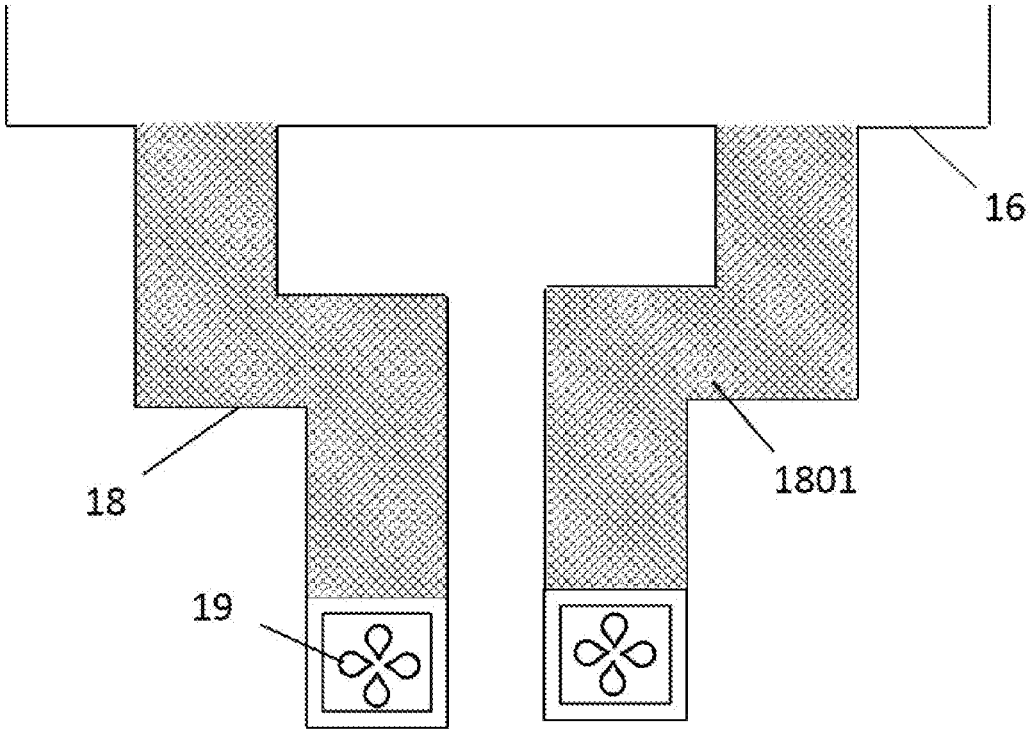
FIG. 7 is a schematic diagram of the structure of a draught fan and an air flow passage.
Figure 8:
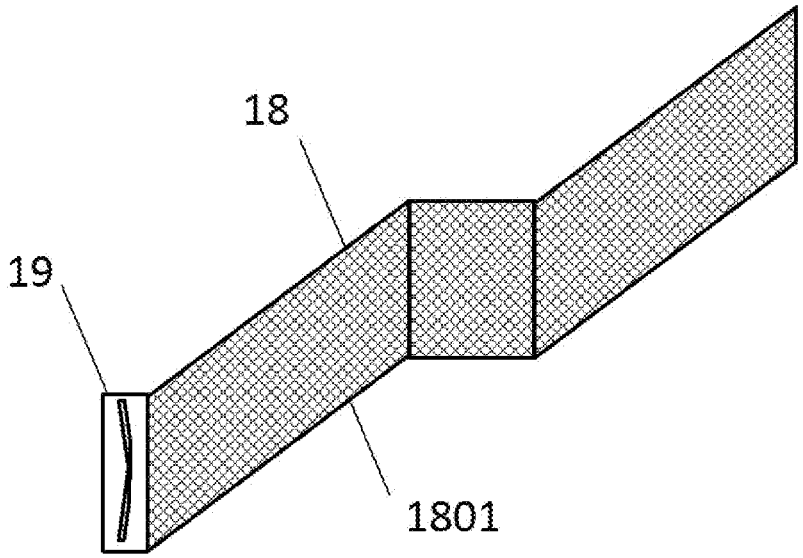
FIG. 8 is a schematic diagram of the structure a draught fan and an air flow passage viewed from another angle.

As shown in FIG. 1, a device for protecting paper sheet in this embodiment includes: a metal base plate 1, an insulating layer 2, a sliding rail holder 3, a sliding rail 4, a second slide block 5, a discharging electrode 6, a discharge driving motor 7, a plasma power supply 8, a first slide block 9, a sprayer 10, a sprayer driving motor 11, a deacidification tank 12, an atomizer 13, a metal base plate moving motor 14, a controller 15, a working cover 16, a cleaning brush 17, an air flow passage 18, a draught fan 19 and an ozone removal pipeline 20. All of the above components can be installed in the chassis 21 to improve integration with easy operation and movement.

The components of access the controller 15 (the discharge driving motor 7, the plasma power supply 8, the sprayer driving motor 11, the atomizer 13 and the metal base plate moving motor 14) can realize automatic control. Each device can also be controlled separately and manually if necessary. The controller 15 can be a programmable logic controller (PLC), a single chip computer or in other forms to control the working of each component.

The metal base plate 1, the insulating layer 2, the sliding rail holder 3, the sliding rail 4, the second slide block 5, the discharging electrode 6, the first slide block 9, the sprayer 10 and the cleaning brush 17 are arranged in the working cover 16.

The discharging electrode 6 and the sprayer 10 can move along the directions of the sliding rail 4 by the first slide block 5 and the second slide block 9 respectively. The metal base plate 1 can move along the horizontal direction perpendicular to the slide rail 4 under the drive of the metal base plate moving motor 14. The discharging electrode 6 and the sprayer 10 are initially located at both ends of the sliding rail 4.

Combining with FIG. 1, the specific structure of this embodiment is shown in FIGS. 2-8. The device for protecting paper sheet of this embodiment includes a chassis 21, which is provided with:

a mist treating system, including a working cover 16 and a suction port provided on the working cover; and a draught fan 19 and an air flow passage 18, one side of the air flow passage 18 is connected to the draught fan 19, and the other side of the air flow passage is connected to the induction port on the working cover 16;

metal base plate 1, slidably provided in the chassis 21; the sidewall of the chassis 21 provides the inlet and outlet of the metal base plate 1;

an insulating layer 2, provided at the top surface of the metal base plate 1;

a sliding rail 4, provided above the metal base plate 1 through the sliding rail holder 3;

a sprayer 10, fixed on the first slide block 9 and movable along the sliding rail 4 for applying an atomized deacidification agent to the sample on the insulating layer 2;

a discharging electrode 6, fixed on the second slide block 5 and movable along the sliding rail 4 to form an electric field with the metal base plate 1 for discharging the sample on the insulating layer 2;

a plasma power supply 8, supplying power to the metal base plate 1 and the discharge electrode 6, generating a linear plasma.

a deacidification tank 12, connected to the sprayer 10 through the atomizer 13 and the corresponding pipeline.

A bearing guide rail is provided in the chassis 21. The metal base plate 1 is slidably provided on the bearing rail. The bearing guide rail and the sliding rail 4 are horizontally arranged and perpendicular to each other in space.

The sprayer 10 includes the nozzle 1001 fixed on the first slide block 9 and arranged horizontally. A slit-shaped discharge outlet 1002 is provided to the nozzle 1001 toward the side of the insulating layer 2 along the length direction of the nozzle. There are three nozzles 1001 are arranged side by side.

The roller type cleaning brush 17 is provided below the static position of the sprayer 10.

The top surface of the insulating layer 2 is provided with a plurality of vacuum suction holes 101 running through to the bottom of the metal base plate 1. A installation groove 102 is provided on the bottom surface of the metal base plate 1. The vacuum suction holes 101 are connected to the groove wall of the installation groove 102. A vacuum tube 103 is embedded in the installation groove 102 and connected to the groove wall of the installation groove 102, and the vacuum tube 103 is connected with a vacuum pump 104. The vacuum pump 104 can be mounted either inside the chassis 21 or connected through an external vacuum line.

The mist treating system includes a working cover 16 and a suction port provided on the working cover; and a draught fan 19 and an air flow passage 18. One side of the air flow passage 18 is connected to the draught fan 19, and the other side of the air flow passage is connected to the induction port on the working cover 16. A mist suction net 1801 is filled in the air passage 18. The mist suction net 1801 is a three-dimensional porous filter net woven by composite metal wires and filled in the air passage 18, wherein, the diameter of the mist suction net is 0.5 mm-3 mm.

In order to remove ozone generated during discharge, an ozone removal pipeline 20 is provided above the sliding rail 4. The ozone is removed by heating at 40-300 C.

In order to improve safety, a safety switch triggered by the reset of the metal base plate 1 is extended out of the chassis 21. After the safety switch is triggered, the whole device for protecting paper sheet is powered on. That is, when the metal base plate 1 is detected, all the components are in the power off state to improve safety. The whole device for protecting paper sheet resumes power supply only after the metal base plate is reset. Specifically, contactors or relays can be provided on the power supply circuit of the device for protecting paper sheet, and controlled by the signal of safety switch.

The device for protecting paper sheet is used for the operation of the following embodiment.

Embodiment 1

(1) The metal base plate 1 is first extended out from the inlet and outlet of the sidewall of the chassis 21. Place the paper sheet to be protected on the insulating layer 2, and start the metal base plate moving motor 14 to move the metal base plate 1 directly below the sliding rail 4.

(2) Open the vacuum pump to make the paper sheet spreading on the insulation board and keep it for 1 minute. Turn on the plasma power supply 8 and open the ozone removal pipeline 20. The heating temperature of the ozone removal pipeline 20 is 40° C., the operating frequency is 15 kHz, the operating voltage is 2 kV, and the operating power is 200 W. The discharge electrode 6 starts to discharge, forming a stable blue-purple filamentary plasma. The discharge electrode 6 is controlled by the discharge driving motor 7 to move back and forth along the sliding rail 4. The full range of scanning of the paper sheet is carried out by using the plasma. The scanning time is 1 minute. After the plasma treatment is completed, close the ozone removal pipeline 20.

In this embodiment, the distance between the discharge electrode and the insulating layer is 2.5 mm.

(3) After the plasma treatment, the deacidification liquid in the deacidification tank 12 is atomized by the atomizer 13 and is sprayed uniformly on the sample through the sprayer 10.

Inject the $Mg(HCO_3)_2$ aqueous solution, which has a pH value of 8.2, into the deacidification tank 12. Spray the atomized deacidification agent generated by the atomizer 13 on the sample uniformly with a flow rate at 100 mL/h by using the sprayer 10 controlled by the sprayer driving motor 11. The spraying time is 50 seconds. After the spray finished, the metal base plate moving motor 14 drives the metal base plate 1 to move out from the below of the sliding rail 4. Then the sample is removed.

When the atomizer 13 starts to work, starting the draught fan 19 at a low speed until the end of the spray. Then adjust the speed of the draft fan 19 to high speed and maintain for 20 seconds.

After spraying, the sprayer 10 is returned to the initial end of the sliding rail 4, and the cleaning brush 17 below the initial end which is used for cleaning the slit-shaped discharge outlet starts to work.

In order to quantify the protective effect and to judge the effect of protective treatment on paper sheet, the pH value is measured according to standard procedures, the pH value and the total number of bacterial colonies of the paper sheet treated by hygrothermal aging are measured according to the standard procedure (according to the national standard GB/T 22894-2008).

After the protective treatment, the total number of bacterial colonies of the paper sheet is changed from 2564 cfu/g to 386 cfu/g.

After protective treatment, the pH value of the paper sheet is changed from 5.6 (acidity) to 7.8 (alkalinity). After hygrothermal aging, the pH value of the paper sheet is 7.6.

Embodiment 2-5

The operation steps of embodiments 2-5 are the same as those of embodiment 1. The parameters of the plasma power supply, the distance between the discharge electrodes and the insulating layer are shown in table 1. In order to quantify the protective effect and to judge the effect of protective treatment on the paper sheet, the pH value is measured according to standard procedures, the pH value and the total number of bacterial colonies of the paper sheet treated by hygrothermal aging are measured according to the standard procedure (according to the national standard GB/T 22894-2008). The results are shown in Table 1.

TABLE 1

| | the operating frequency of the plasma power supply (kHz) | the operating power of the plasma power supply (W) | the operating voltage of the plasma power supply (kV) | the distance between the discharge electrode and the insulating layer (mm) | the pH value before protective treatment | the pH value after protective treatment | the pH value after hygrothermal aging | the total number of bacterial colonies before hygrothermal aging (cfu/g) | the total number of bacterial colonies after hygrothermal aging (cfu/g) |
|---|---|---|---|---|---|---|---|---|---|
| Embodiment 2 | 5 | 150 | 0.8 | 1 | 4.6 | 7.5 | 7.5 | 3864 | 204 |
| Embodiment 3 | 20 | 300 | 1 | 2 | 5.2 | 8.0 | 7.4 | 2365 | 415 |
| Embodiment 4 | 8 | 500 | 15 | 3 | 5.5 | 7.7 | 7.4 | 3532 | 489 |
| Embodiment 5 | 50 | 1000 | 20 | 4 | 4.8 | 8.3 | 8.0 | 4572 | 213 |

Comparative Embodiment 1

The device and samples used in this comparative embodiment are the same as those in embodiment 1. The difference lies in the following steps in the using process (1) The metal base plate 1 is firstly extended from the inlet and outlet of the sidewall of the chassis 21. Place the paper sheet to be protected on the insulating layer 2. Start the base plate moving motor 14 to move the metal base plate 1 directly below the sliding rail 4.

(2) Open the vacuum pump to make the paper sheet spreading on the insulation board and keep it for 1 minute.

The deacidification liquid in the deacidification tank 12 is atomized by the atomizer 13 and is sprayed uniformly on the sample through the sprayer 10.

Inject the $Mg(HCO_3)_2$ aqueous solution, which has a pH value of 8.2 into the deacidification tank 12. Spray the atomized deacidification agent generated by the atomizer 13 on the sample uniformly with a flow rate at 100 mL/h by using the sprayer 10 controlled by the sprayer driving motor 11. The spraying time is 50 seconds.

After spraying, the sprayer 10 is returned to the initial end of the sliding rail 4, and the cleaning brush 17 below the initial end which is used for cleaning the slit-shaped discharge outlet starts to work.

(3) After spraying, turn on the plasma power supply 8. The operating frequency is 15 kHz, the operating voltage is 2 kV, and the operating power is 200 W. The discharge electrode 6 starts to discharge, forming a stable blue-purple filamentary plasma. The discharge electrode 6 is controlled by the discharge driving motor 7 to move back and forth along the sliding rail 4. The full range of scanning of the paper sheet is carried out by using the plasma. The scanning time is 50s to complete the plasma treatment. After the plasma treatment is completed, the metal base plate moving motor 14 drives the metal base plate 1 to move out from the below the sliding rail 4. Then the sample is removed.

In this embodiment, the distance between the discharge electrode and the insulating layer is 2.5 mm.

In order to quantify the protective effect and to judge the effect of protective treatment on paper sheet, the pH value is measured according to standard procedures, the pH value and the total number of bacterial colonies of the paper sheet treated by hygrothermal aging are measured according to the standard procedure (according to the national standard GB/T 22894-2008). The results are shown in table 2.

TABLE 2

| | the pH value before protective treatment | the pH value after protective treatment | the pH value after hygrothermal aging | the total number of bacterial colonies before hygrothermal aging (cfu/g) | the total number of bacterial colonies after hygrothermal aging (cfu/g) |
|---|---|---|---|---|---|
| Embodiment 1 | 5.6 | 7.8 | 7.6 | 2564 | 386 |
| Comparative embodiment 1 | 5.6 | 7.5 | 7.2 | 2564 | 542 |

Comparative Embodiment 2

Compared with the embodiment 1, the difference is that the device does not have a mist treating system. The selected samples are the same as the embodiment 1, and the other operation parameters are the same as the embodiment 1.

In order to quantify the protective effect and to judge the effect of protective treatment on paper sheet, the pH value is measured according to standard procedures, the pH value and the total number of bacterial colonies of the paper sheet treated by hygrothermal aging are measured according to the standard procedure (according to the national standard GB/T 22894-2008). The results are shown in table 3.

TABLE 3

| | the pH value before protective treatment | the pH value after protective treatment | the pH value after hygrothermal aging | the total number of bacterial colonies before hygrothermal aging (cfu/g) |
|---|---|---|---|---|
| Embodiment 1 | 5.6 | 7.8 | 2564 | 386 |
| Comparative embodiment 2 | 5.6 | 6.9 | 2564 | 538 |

Comparative Embodiment 3

Compared with the embodiment 1, the difference is that there is no vacuum suction holes on the top of the insulating layer in this device, and the paper sheet is not pretreated by the negative pressure generated by the vacuum suction holes before the discharge electrode starts to work. The selected samples are the same as the embodiment 1, and the other operation parameters are the same as the embodiment 1.

In order to quantify the protective effect and to judge the effect of protective treatment on paper sheet, the pH value is measured according to standard procedures, the pH value and the total number of bacterial colonies of the paper sheet treated by hygrothermal aging are measured according to the standard procedure (according to the national standard GB/T 22894-2008). The results are shown in table 4.

TABLE 4

| | the pH value before protective treatment | the pH value after protective treatment | the pH value after hygrothermal aging | the total number of bacterial colonies before hygrothermal aging (cfu/g) |
|---|---|---|---|---|
| Embodiment 1 | 5.6 | 7.8 | 2564 | 386 |
| Comparative embodiment 3 | 5.6 | 7.4 | 2564 | 421 |

In summary, the device for protecting paper sheet of the embodiment has the advantages of simple structure, convenient to use, and can quickly and effectively deacidify and sterilize the paper sheet.

What is claimed is:

1. A device for protecting paper sheet, comprising:

a mist treating system, including a working cover and a suction port provided on the working cover;

the mist treating system includes a draught fan and an air flow passage, one side of the air flow passage is connected to the draught fan, and the other side of the air flow passage is connected to an induction port on the working cover, a mist suction net is included in an inside of the air flow passage;

a flat metal base plate in a drawer structure capable of being drawn out from the working cover in a horizontally slidable manner, an inlet and outlet are provided on a vertical sidewall of the working cover;

a bearing guide rail, provided in the working cover and carried the metal base plate moving through the inlet and outlet on the sidewall of the working cover;

an insulating layer provided at a top surface of the metal base plate;

a sliding rail arranged above the metal base plate;

a sprayer movable along the sliding rail and used for applying an atomized deacidification agent to a paper sheet;

a discharging electrode movable along the sliding rail and used for discharging to the paper sheet on the insulating layer;

the working cover being covered outside of the metal base plate, the insulating layer, the sliding rail, the sprayer, and the discharging electrode;

and a plasma power supply supplying power to the metal base plate and the discharging electrode, and generating linear plasma;

wherein the bearing guide rail and the sliding rail are horizontally arranged and are perpendicular to each other in space;

wherein the sprayer includes:

a first slide block movable along the sliding rail;

a nozzle fixed on the first slide block and arranged horizontally, the nozzle toward a side of the insulating layer is provided with a slit-shaped discharge outlet along the longitudinal direction of the nozzle;

wherein a roller type cleaning brush is provided below a static position of the sprayer;

wherein the discharging electrode moves along the sliding rail by a second slide block which the discharging electrode is fixed with;

wherein the protecting paper sheet includes a deacidification tank and an atomizer, a liquid inlet of the atomizer is connected to the deacidification tank, and an atomization outlet of the atomizer is connected to the sprayer;

wherein the top surface of the insulating layer is provided with a plurality of vacuum suction holes running through to a bottom surface of the metal base plate, and a vacuum tube is embedded in the bottom surface of the metal base plate, side walls of the vacuum tube are connected with the vacuum suction holes, and the vacuum tube is connected with a vacuum pump; an installation groove is provided on the bottom surface of the metal base plate, and the vacuum suction holes are connected to a groove wall of the installation groove, the vacuum tube is embedded in the installation groove;

wherein the plasma power supply is an intermediate frequency high voltage power supply with an operating frequency of 15 kHz, an operating voltage of 2 kV, and an operating power of 200 W;

wherein a distance between the discharging electrode and the insulating layer is 2.5 mm; and wherein an ozone removal pipeline is provided above the sliding rail.

* * * * *